US009873280B1

(12) United States Patent
Nelson et al.

(10) Patent No.: US 9,873,280 B1
(45) Date of Patent: Jan. 23, 2018

(54) FERRIS WHEEL GREETING CARD

(71) Applicant: American Greetings Corporation, Cleveland, OH (US)

(72) Inventors: Gary Nelson, Avon, OH (US); John Talbot, Bay Village, OH (US); Seth Larson, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 15/615,701

(22) Filed: Jun. 6, 2017

(51) Int. Cl.
*B42D 15/02* (2006.01)
*B42D 15/04* (2006.01)

(52) U.S. Cl.
CPC ..... *B42D 15/022* (2013.01); *B42D 15/042* (2013.01); *B42D 15/047* (2013.01); *B42D 15/04* (2013.01)

(58) Field of Classification Search
CPC ..... G09F 1/06; B42D 15/022; B42D 15/042
USPC ..... 40/124.08
See application file for complete search history.

(56) References Cited

U.S. PATENT DOCUMENTS

| | | | | |
|---|---|---|---|---|
| 849,426 | A * | 4/1907 | Reiman | G09F 7/00 229/92.8 |
| 922,715 | A * | 5/1909 | Munster | G09F 1/00 229/92.8 |
| 5,641,063 | A * | 6/1997 | Gambardella | B65D 85/546 206/308.1 |
| 7,552,553 | B2 * | 6/2009 | Kelly | B42D 15/045 40/124.08 |
| 8,250,790 | B2 | 8/2012 | Wong | |
| 9,156,301 | B2 | 10/2015 | Flesher | |
| 9,469,146 | B2 | 10/2016 | Bogdanski et al. | |
| 9,475,333 | B2 | 10/2016 | Yeh | |
| 2016/0068003 | A1 * | 3/2016 | Bogdanski | B42D 15/042 40/124.03 |
| 2016/0114613 | A1 * | 4/2016 | Bogdanski | B42D 15/042 40/124.03 |
| 2016/0159135 | A1 * | 6/2016 | Talbot | B42D 15/042 40/124.03 |
| 2017/0120659 | A1 * | 5/2017 | Marsh | B42D 15/022 |

* cited by examiner

*Primary Examiner* — Gary C Hoge
(74) *Attorney, Agent, or Firm* — Christine Flanagan

(57) ABSTRACT

A greeting card having special effects such as lights, sound and motor movement of a pop-up structure. The pop-up structure is in the form of a miniature faux Ferris wheel. When the greeting card is opened, the Ferris wheel begins to turn, the lights are illuminated and audio begins to be emitted through a speaker.

18 Claims, 7 Drawing Sheets

FERRIS WHEEL GREETING CARD

RELATED APPLICATIONS

There are no applications related to this application.

FIELD OF THE INVENTION

The invention is in the field of social expression products and is more specifically directed to greeting cards having one or more special effects.

SUMMARY OF THE INVENTION

In one embodiment, the greeting card of the present disclosure and related inventions includes a greeting card body and a pop-up structure being attached to the greeting card body and having a plurality of die cut shapes attached thereto about a pivot point and also having one or more lights attached thereto. A motor is attached to the pop-up structure which is operative to cause movement of at least a portion of the pop-up structure and a switch is operative to control activation of the motor and illumination of the one or more lights.

In another embodiment, the greeting card includes a greeting card body and a pop-up structure which is attached to the greeting card body and which comprises an a-frame structure which supports a rotating upright or vertical disc or wheel. A motor is attached to the pop-up structure for causing movement of the wheel or disc, when activated by a switch.

In still another embodiment, the greeting card includes a greeting card body and a pop-up structure attached to the greeting card body which contains a first portion attached to a left inside panel of the greeting card body, a second portion which is attached to a right inside panel of the greeting card body, and a third portion which is attached between the first and second portions of the pop-up structure. A motor is connected to the pop-up structure which is operative to cause movement of the third portion of the pop-up structure when activated by a switch.

DETAILED DESCRIPTION OF PREFERRED AND ALTERNATE EMBODIMENTS

The present invention includes a greeting card 100 with pop-up structure having light and sound capabilities and a motor module to effect movement of the pop-up structure.

The greeting card body 12, in one embodiment, includes four greeting card panels. A first panel 12A is connected to a second panel 12B along a first or main fold line F1 and to a third panel 12C along a second fold line F2. The second panel 12B is connected to a fourth panel 12D along a third fold line F3. The third panel 12C may be located directly above the first panel 12A with the second fold line F2 being located horizontally along the uppermost edge of the first panel 12A, or the third panel 12C may be located directly to the left of the first panel 12A with the second fold line F2 being located vertically along the leftmost edge of the first panel 12A. Likewise, the fourth panel 12D may be located directly above the second panel 12B with the third fold line F3 being located horizontally along the uppermost edge of the second panel 12B, or the fourth panel 12D may be located directly to the right of the second panel 12B with the third fold line F3 being located vertically along the right-most edge of the second panel 12B. A first planar P1 insert may be placed between the first 12A and third 12C panels and a second planar insert P2 may be placed between the second 12B and fourth 12D panels. The first and second planar inserts P1, P2, in one embodiment, are square or rectangular transparent plastic sheets. The sheets P1, P2 may extend beyond the right and left sides of the greeting card body 12 to extend the front and back covers of the greeting card 100 in order to accommodate the size of the pop-up structure 14 located on the inside surface of the greeting card 100. It also adds strength and rigidity to the greeting card body 12. The third panel 12C is folded over the first panel 12A (and first planar insert P1) and attached thereto and the fourth panel 12D is folded over the second panel 12B (and second planar insert P2) and attached thereto. The first panel 12A serves as the front cover of the greeting card 100, the second panel 12B serves as the back or rear panel of the greeting card 100, the third panel 12C serves as the inside left panel of the greeting card 100, and the fourth panel 12D serves as the inside right panel of the greeting card 100. The greeting card body 12 may be made of paperboard, cardboard, plastic or any other suitable material. The panels 12 may contain printing thereon which may include text sentiment, drawings, photos, pictures or any other printable matter. The panels 12 may additionally contain glitter, faux fur, faux gems, or any other decorative effect. The panels 12, particularly the inside right panel 12D, may contain blank space onto which a user may write sentiment and/or a signature.

Figure 1:
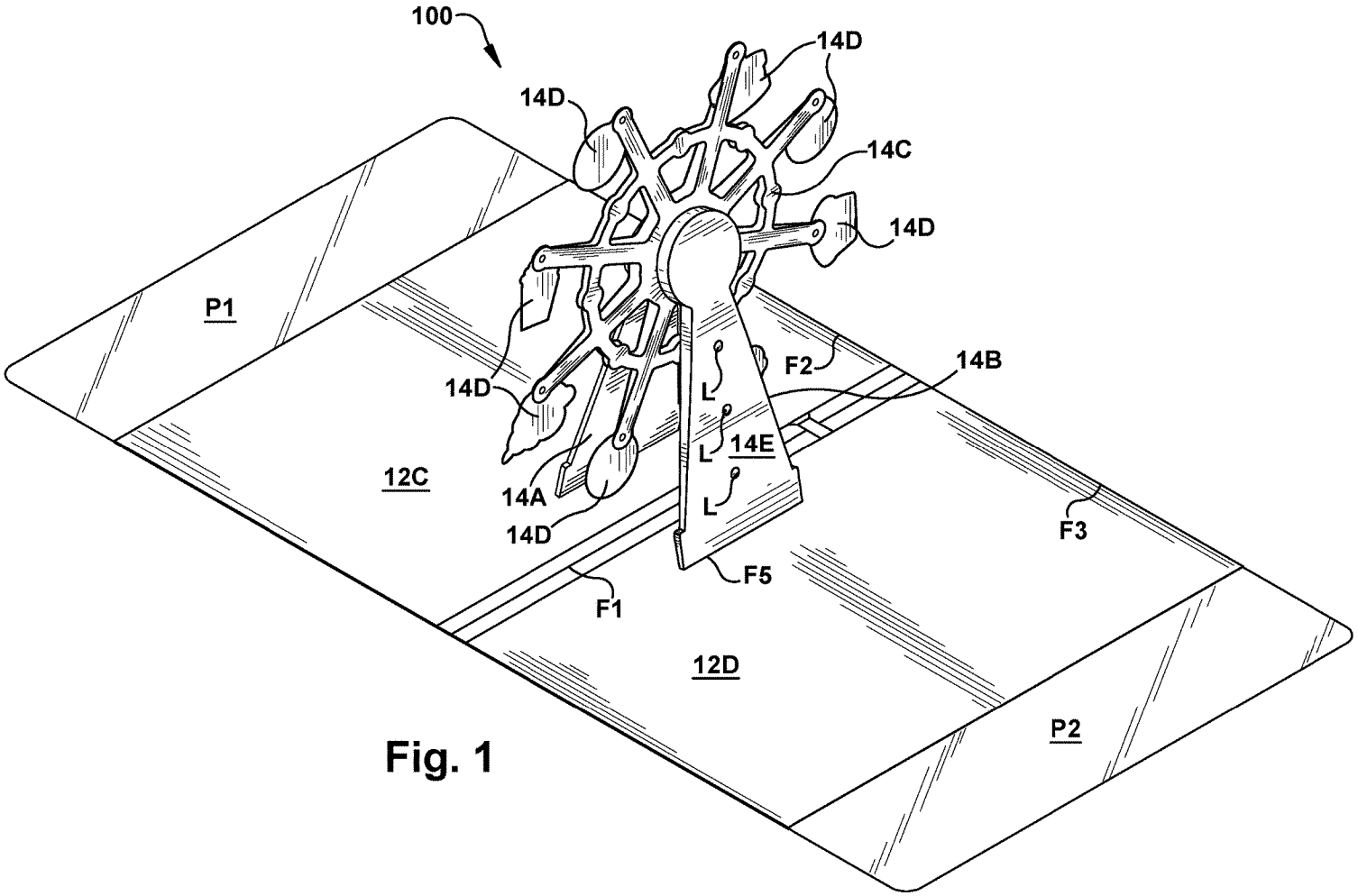
FIG. 1 is a perspective view of the greeting card of the present invention, in an open position.
Figure 2:
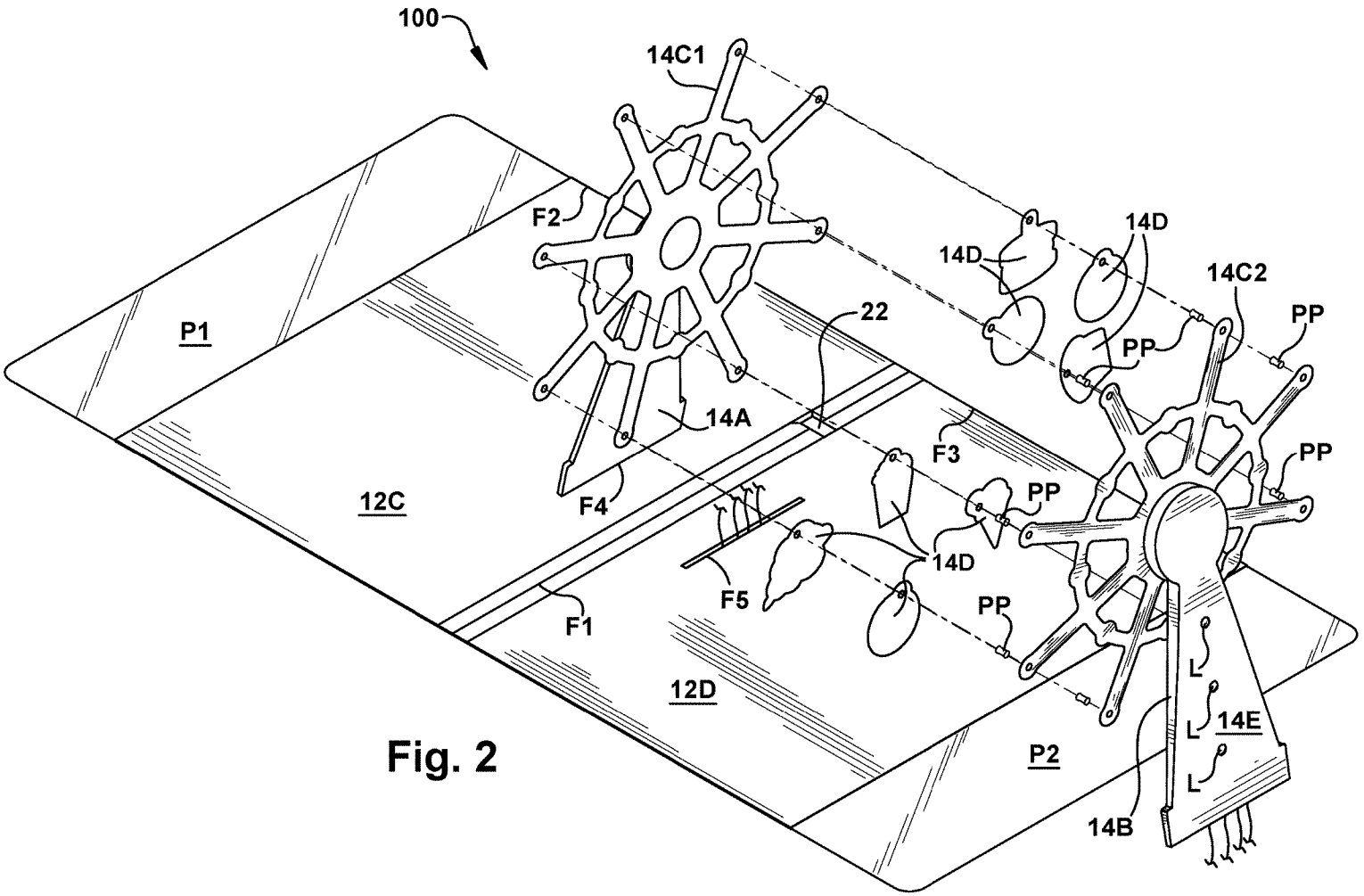
FIG. 2 is an exploded view of the greeting card of FIG. 1.
Figure 3:
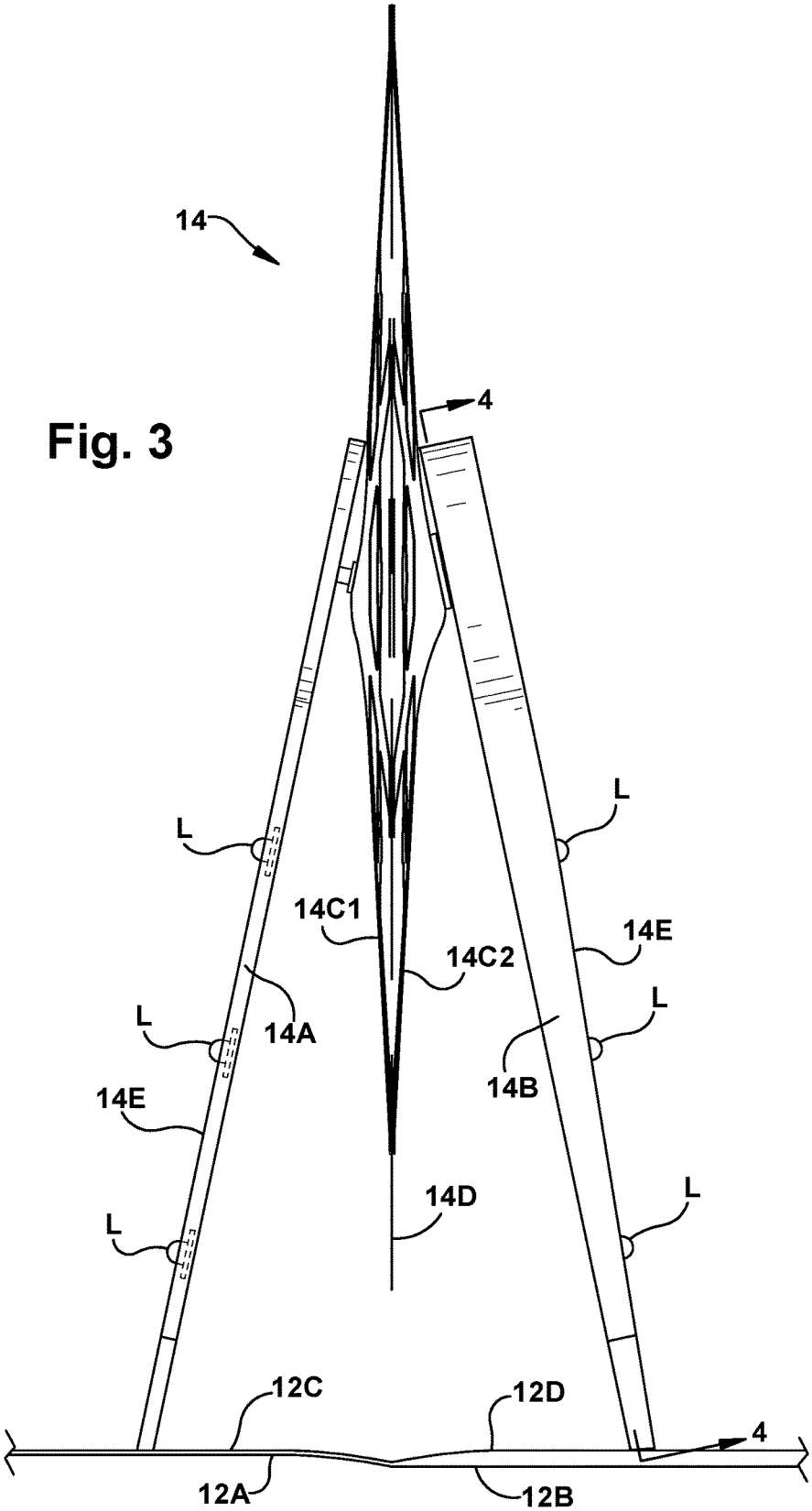
FIG. 3 is a side view of the pop-up structure of the greeting card of FIG. 1.
Figure 4:
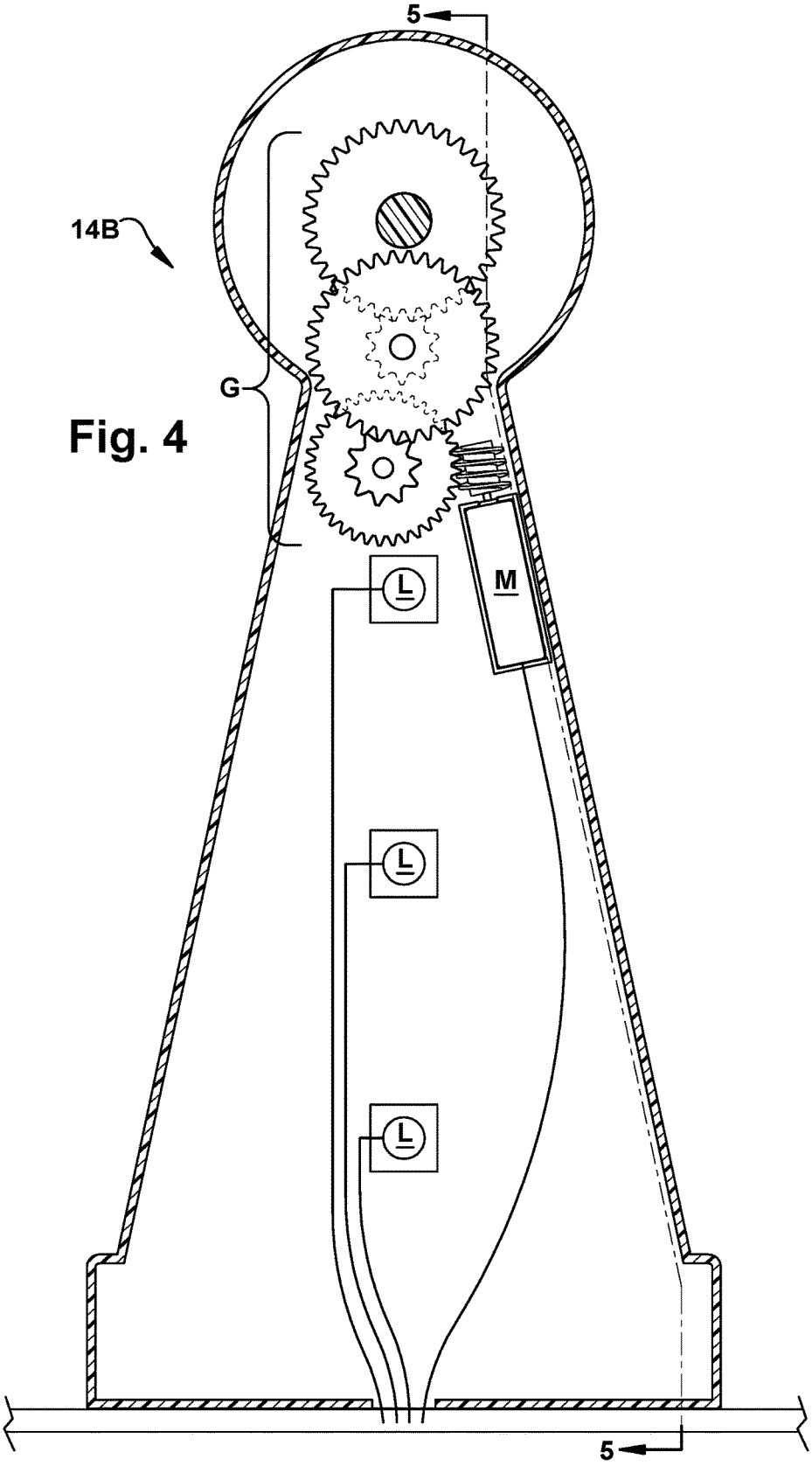
FIG. 4 is a front view of a portion of the pop-up structure of FIG. 3, from the perspective of arrows 4-4.
Figure 5:
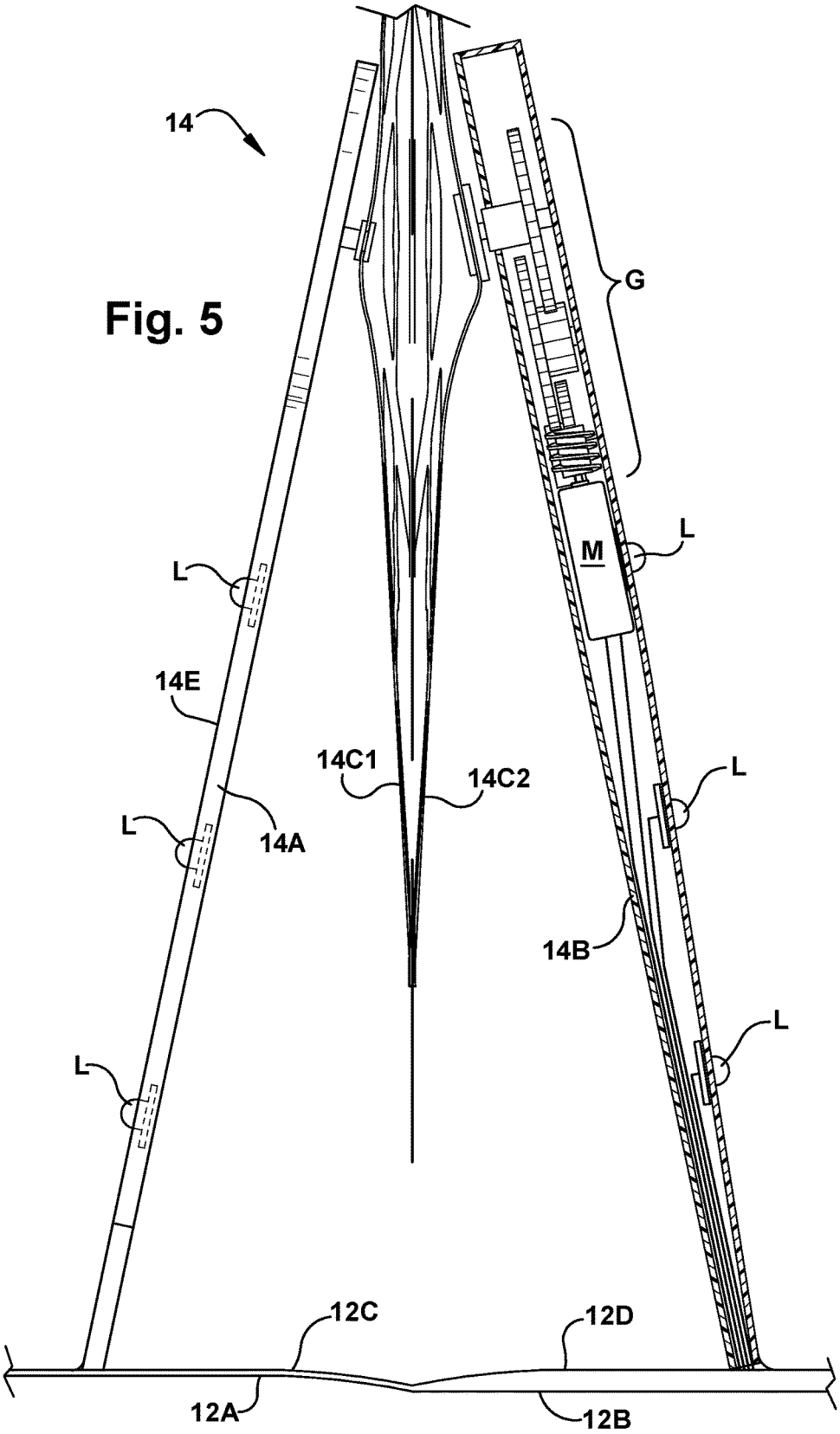
FIG. 5 is a cross-sectional view of a portion of the pop-up structure of FIG. 4, from the perspective of arrows 5-5.
Figure 6:
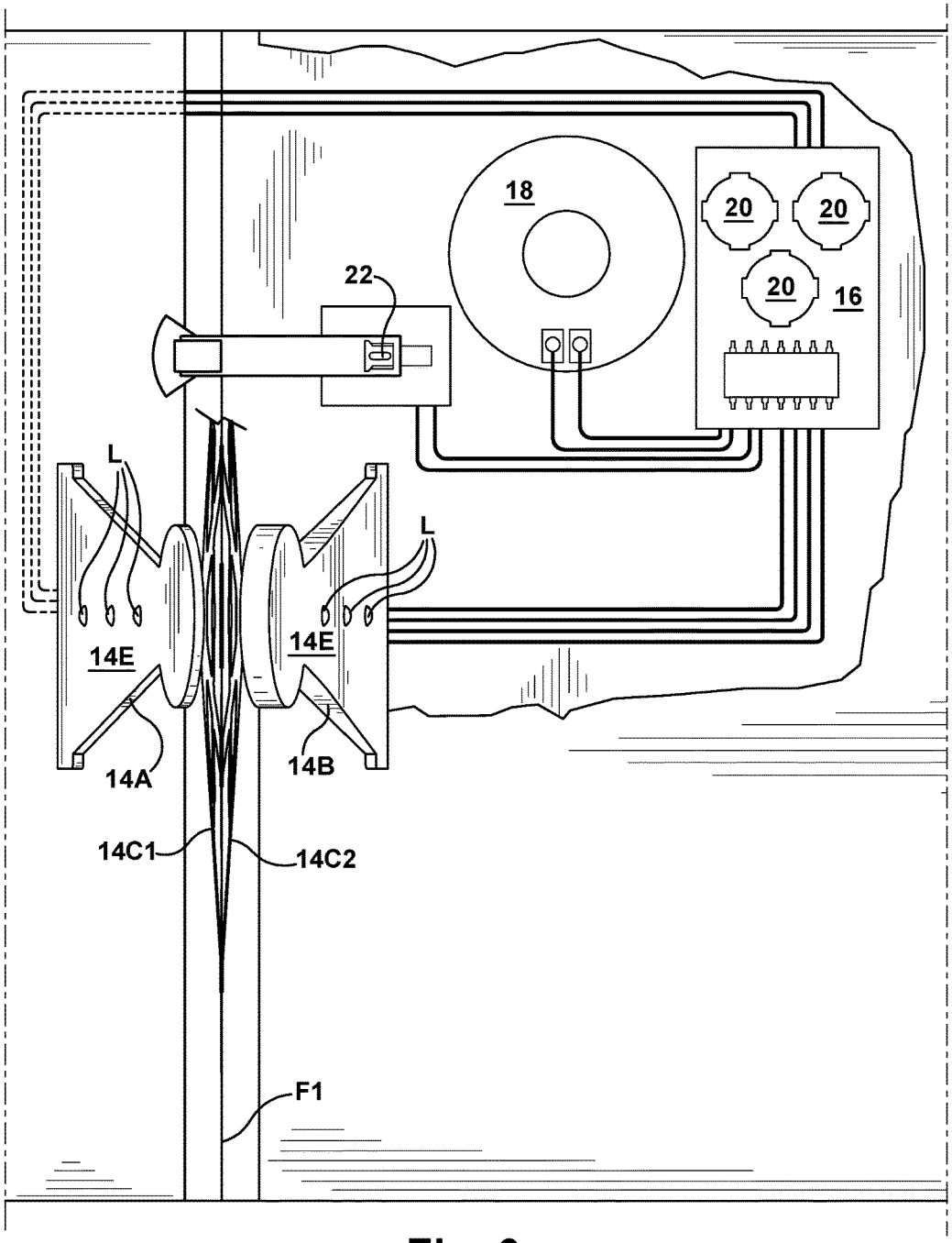
FIG. 6 is a top down tear-away view of a portion of the greeting card of FIG. 1.

The pop-up structure 14, in one embodiment, is shaped as a miniature Ferris wheel. The miniature Ferris wheel 14 includes an a-frame structure 14A, 14B supporting a rotating upright or vertical disc or wheel 14C with a plurality of faux passenger cars (or other shapes) 14D attached, at a pivot point PP, to an outer rim thereof such that when the disc or wheel 14C rotates, the faux passenger cars (or other shapes) 14D are maintained in an upright position. The a-frame structure contains two lateral support arms, a left lateral support arm 14A and a right lateral support arm 14B. In one embodiment, the left and right lateral support arms 14A, 14B are made of a rigid material, such as plastic, with a die cut shape or cover 14E attached to the outer surface thereof. In one embodiment, the right lateral support arm 14B serves as or houses the motor M that causes the wheel 14C to rotate, as described in further detail below and as shown in FIGS. 4 and 5. The die cut shape or cover 14E may be contiguous with the greeting card body 12 and attached thereto along minor fold lines F4, F5. This facilitates attachment of the support arms 14A, 14B to the greeting card body 12 and allows the support arms 14A, 14B to bend or fold about the minor fold lines F4, F5 and lie substantially flat between the front 12A, 12C and rear 12B, 12D covers of the greeting card 100, when the greeting card 100 is in a closed position. The lateral support arms 14A, 14B also contain lights L which are attached to an outer surface thereof, and which are located between the plastic (or other rigid material) and the die cut cover 14E on each of the lateral support arms 14A, 14B and are seen through one or more openings in the die cut cover 14E. Wires or other related circuitry connect the lights L to the circuit board 16. These wires or other circuitry are concealed beneath the die cut cover 14E over the outer surface of the lateral support arms 14A, 14B and partially by the greeting card body 12, as shown in FIG. 6. Each support arm 14A, 14B is independently attached, at one end, to the greeting card body 12, as described above, and at the other end to the die cut wheel 14C. The left lateral support arm 14A is attached to the left inside panel 12C of the greeting card and the right lateral support arm 14B is attached to the right inside panel 12D of the greeting card 100. The die cut wheel 14C, in one embodiment, contains two separate, identical die cut shapes, a left side wheel 14C1 and a right side wheel 14C2, both having a circular shape with a plurality of spokes extending outward therefrom. Each of the wheel shapes 14C1, 14C2 has an inner surface and an outer surface directly opposite the inner surface. The outer surface of the left wheel shape 14C1 is attached to the left lateral arm 14A and the outer surface of the right wheel shape 14C2 is attached to the right lateral arm 14B. The inner surfaces of the left and right side wheel shapes 14C1, 14C2 are attached to one another at the distal end of each spoke by a small joint PP. Between the right and left wheel shapes 14C1, 14C2 at each of the plurality of spokes is a miniature die cut shape 14D (shown in FIG. 2) which pivots about the joint PP as the wheel 14C rotates. The miniature die cut shapes 14D attached to the die cut wheel 14C may all have the same shape or may have different shapes. The miniature die cuts shapes 14D may be in the shape of passenger cards, or in another embodiment, the miniature die cut shapes 14D are, for example, miniature snacks, such as pretzels, corn dogs, ice cream cones, pizza, French fries, etc. In another embodiment, the miniature die cut shapes are all piñatas. The miniature die cut shapes 14D may be any conceivable shape. In order to facilitate the pop-up aspect of the Ferris wheel structure 14, as noted above, each of the lateral support arms 14A, 14B is attached directly to the greeting card body 12 about a minor fold line F4, F5. This allows the Ferris wheel or pop-up structure 14 to move between a first position, wherein it is in a substantially horizontal or flat position between the front 12A, 12C and rear 12B, 12D greeting card panels and a second position wherein it is in a substantially vertical or upright position. When the pop-up structure 14 is in the first position (when the greeting card 100 is in a closed position with the cover panel 12A, 12C overlying the rear panel 12B, 12D), the left lateral support arm 14A is collapsed to lie onto the right lateral support arm 14B.

In one embodiment, the greeting card 100 additionally includes a sound module and a motor module. The sound module, as shown in FIG. 6, may include, but is not limited to: a printed circuit board with integrated circuit chip 16; a speaker 18; a memory device which is operative to store at least one audio file; a power source 20, such as one or more batteries; a switch 22; and various wires and circuitry which connect the various components. The sound module may include any component which facilitates or which improves the storage of one or more audio files and playback of the at least one audio file through the speaker 18. In one embodiment, the sound module is contained within the cavity created between the second (rear) 12B and fourth (inside right) 12D greeting card panels. The at least one audio file may contain music, a song, spoken word, or any other recordable sound. The motor module may include a small motor M with rotating gear mechanism G (as shown in FIG. 4) which may be attached to the printed circuit board 16 described above with respect to the sound module. In one embodiment, the right lateral support arm 12B also serves as or houses the motor M which is connected to the die cut wheel 12C. When the motor M is activated, the die cut wheel 12C rotates or moves in a circular motion and the miniature die cut shapes 12D attached thereto dangle therefrom and pivot about the joint or attachment point PP to remain in an upright position while the wheel 12C rotates. In one embodiment, the greeting card 100 also contains a light module which includes one or more lights L which may be attached to the printed circuit board 16, described above with respect to the sound module. As describe above, each of the right and left lateral support arms 14A, 14B contain three lights L along the outside surface (on the die cut shape or cover 14E) in a vertical configuration. The lights L may be programmed to simply turn on or they may be programmed to blink, twinkle, flash, change colors, or perform other lighting effects or a combination thereof.

Figure 7:
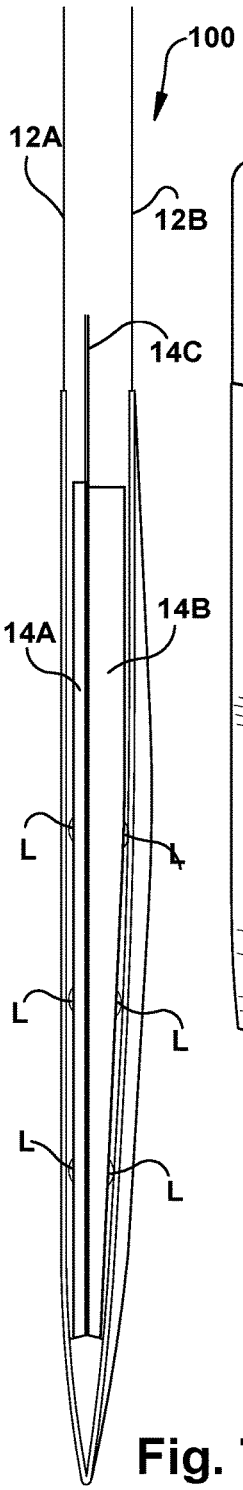
FIG. 7 is a left side view of the greeting card of FIG. 1, in a closed position.
Figure 8:
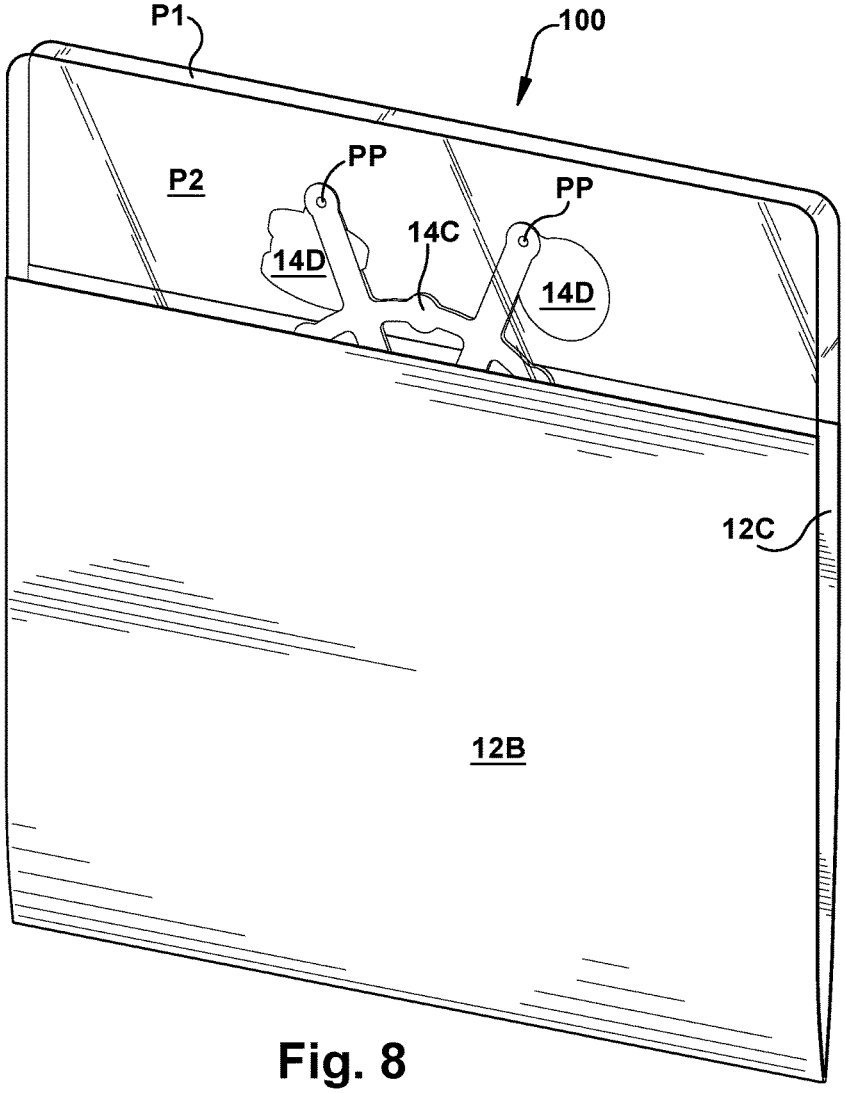
FIG. 8 is a perspective view of the greeting card of FIG. 7.

In operation, the greeting card 100 is presented to a recipient in a closed or folded position (perhaps within a greeting card envelope), with the pop-up structure 14 in a first position wherein it is in a substantially horizontal or flat position between the front 12A, 12C and rear panels 12B, 12D of the greeting card 100, as shown in FIGS. 7 and 8. When the recipient opens the greeting card 100, the pop-up structure 14 moves to a second position wherein it is substantially vertical or upright, as shown in FIGS. 1, 3, 5 and 6. A slide tongue switch 22 is attached to the greeting card body 12 over the first or main fold line F1. When the greeting card 100 is opened, the slide tongue is pulled from between the contact points, thereby triggering the sound, motor and light modules. The die cut wheel 14C begins to rotate, the lights L contained on the left and right lateral support arms 14A, 14B are illuminated, and the sound module plays back the at least one audio file through the speaker 18. The movement, light and sound may continue for a predetermined amount of time, such as, for example, twenty (20) seconds while the greeting card 100 remains in an open position or the movement, light and sound may continue for as long as the greeting card 100 is maintained in an open position. When the greeting card 100 is closed, the motor, lights and sound are deactivated. Re-opening the greeting card 100 again activates the motor, light and sound.

In one embodiment, the greeting card 100 of the present disclosure and related inventions may also include a gift card holder for storing a gift card therein. The term "gift card" is also intended to cover other non-gift card items which can be held in the "gift card holder" or other holding or containment mechanism described herein for holding a gift card. Such non-gift card items include, but are not limited to: cash, gift certificates, checks, vouchers, coupons, notes, lottery tickets, tickets to entertainment events, calling cards, business cards, collectable cards, small gift items or cards or coins or other substrate with a QR code, digital watermark, bar code (or other digital code or mark which can be decoded) having stored therein or being linked to digital or electronic content such as games, music, videos, movies, books, magazine subscriptions, photographs, or other such digital content. The gift card holder may be in the form of an open-sided pocket or sleeve into which a gift card may be inserted and removed. The pocket or sleeve may cover a substantial portion of the greeting card or it may cover only a portion of the greeting card. In a preferred embodiment, the gift card pocket or sleeve is rectangular shaped (similar to but slightly larger than the size of a traditional gift card) having an opening along the top, right, or left edge thereof for insertion and removal of the gift card. The front surface of the gift card pocket or sleeve may be completely or partially transparent so that the recipient can view at least a portion of the gift card contained within the sleeve or pocket. Alternatively, the gift card pocket may not be transparent, but a portion of the gift card may be visible or outside of the gift card holder. The gift card holder may alternately be in the form of a closed pocket which may be opened and closed for insertion and removal of a gift card. The pocket may have a flap which can be lifted to reveal a gift card inside or a slot which can be contained on a front face of the sleeve or pocket, or any such opening for inserting and removing a gift card. The gift card holder may be contained on a front or outside surface of the greeting card or may be contained on an inside surface of the greeting card. Alternatively, the gift card holder may be attached to the Ferris wheel or pop-up structure.

While the greeting card of the present disclosure and related inventions has been described herein as having a motor, light and sound, in other embodiments, the greeting card may contain only one or only two of the motor, light and sound effects. The motor has been described herein and shown in the figures as being a slide switch, however, other types of switches may be used, such as a magnetic switch, contact switch, push button switch, light sensitive switch, touch sensitive switch; sound sensitive switch or any other small motor. The greeting card body has also been described as having four panels located in a particular arrangement, however, the greeting card body may include fewer than four panels, such as one, two or three and the panels may be arranged in a variety of ways. Also, a single switch has been described herein as controlling activation of the motor, light and sound, however, two or three switches may be used and the two or three switches may be of the same type of switch or different. The motor module has been described as being in the right lateral arm, however, the motor may be located in the left lateral arm or may be attached and concealed within the greeting card body. The die cut wheel has been described as having two separate, identical die cut shapes, however, a single shape may alternatively be used. The miniature die cut shapes which have been described as being attached to the die cut wheel may be of different shapes and sizes or of the same shape and size. Alternatively, the die cut wheel may not contain any miniature die cut shapes attached thereto. The foregoing embodiments of the present invention have been presented for the purposes of illustration and description.

These descriptions and embodiments are not intended to be exhaustive or to limit the invention to the precise form disclosed, and obviously, many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A greeting card comprising:

a greeting card body;

a pop-up structure attached to the greeting card body, the pop-up structure having a plurality of die cut shapes attached thereto about a pivot point and also having one or more lights attached thereto;

a motor attached to the pop-up structure which is operative to cause movement of at least a portion of the pop-up structure; and a switch which is operative to control activation of the motor and illumination of the one or more lights;

wherein the pop-up structure is a faux miniature Ferris wheel.

2. The greeting card of claim 1 further comprising a sound module which is controlled by the switch and which is operative to store and playback at least one audio file.

3. The greeting card of claim 2, wherein when the greeting card is opened, the motor causes at least a portion of the pop-up structure to move, the one or more lights are illuminated, and the sound module to play the at least one audio file through a speaker.

4. The greeting card of claim 1, wherein when the greeting card is opened, the motor causes at least a portion of the pop-up structure to move and the one or more lights are illuminated.

5. The greeting card of claim 1, wherein when the greeting card is opened, the pop-up structure moves from a first position wherein it is collapsed or substantially flat and a second position wherein it is upright.

6. A greeting card comprising:

a greeting card body;

a pop-up structure attached to the greeting card body, the pop-up structure comprising an a-frame structure which supports a rotating upright or vertical disc or wheel;

a motor attached to the pop-up structure, the motor causing movement of the wheel or disc portion of the pop-up structure when activated; and a switch which controls activation of the motor;

wherein the pop-up structure further includes a plurality of die cut shapes attached to the disc or wheel.

7. The greeting card of claim 6 further comprising a sound module operative to store and playback at least one audio file through a speaker.

8. The greeting card of claim 6 further comprising a light module operative to illuminate one or more lights attached to the pop-up structure.

9. The greeting card of claim 8 wherein the one or more lights are attached to the a-frame of the pop-up structure.

10. The greeting card of claim 6, wherein when the greeting card is in a closed position, the pop-up structure is collapsed between two or more panels of the greeting card body.

11. The greeting card of claim 6, wherein each of the plurality of die cut shapes are attached to the disc or wheel of the pop-up structure about a pivot point.

12. The greeting card of claim 6, wherein the motor is attached to the a-frame portion of the pop-up structure.

13. A greeting card comprising:

a greeting card body;

a pop-up structure attached to the greeting card body, a first portion of the pop-up structure attached to a left inside panel of the greeting card body, a second portion of the pop-up structure attached to a right inside panel of the greeting card body, and a third portion of the pop-up structure attached between the first and second portions of the pop-up structure;

a motor which is connected to the pop-up structure, the motor operative to cause movement of the third portion of the pop-up structure;

a switch attached to the greeting card body which controls activation of the motor;

wherein the pop-up structure is operative to move between a first position wherein the first, second and third portions of the pop-up structure are folded into a substantially flat position and a second position wherein the first and second portions of the pop-up structure form an a-frame structure and the third portion rotates about a horizontal axis.

14. The greeting card of claim 13, wherein the pop-up structure moves from a first or collapsed position to a second or upright position upon opening of the greeting card.

15. The greeting card of claim 13 further comprising a sound module which is operative to store at least one audio file and playback said at least one audio file through a speaker when activated.

16. The greeting card of claim 15, wherein the switch controls activation of the sound module.

17. The greeting card of claim 13 further comprising one or more lights.

18. The greeting card of claim 17, wherein the switch controls illumination of the one or more lights.

* * * * *